United States Patent [19]

Perepezko et al.

[11] 4,321,086

[45] Mar. 23, 1982

[54] PREPARATION OF MICRON SIZED METAL DROPLETS

[75] Inventors: John H. Perepezko, Madison, Wis.; Don H. Rasmussen, Canton, N.Y.; Carl R. Loper, Jr., Madison, Wis.

[73] Assignee: Wisconsin Alumni Research Foundation, Madison, Wis.

[21] Appl. No.: 190,948

[22] Filed: Sep. 26, 1980

[51] Int. Cl.[3] ..... B22D 23/08

[52] U.S. Cl. ..... 75/0.5 C; 264/7

[58] Field of Search ..... 75/0.5 C, 0.5 R, 0.5 B; 264/7-14

[56] References Cited

U.S. PATENT DOCUMENTS

| | | | |
|---|---|---|---|
| 2,371,105 | 3/1945 | Lepsoe | 75/0.5 C |
| 3,247,014 | 4/1966 | Goldberger et al. | 264/7 |
| 4,282,034 | 8/1981 | Smith et al. | 264/7 |

*Primary Examiner*—W. Stallard

*Attorney, Agent, or Firm*—McDougall, Hersh & Scott

[57] ABSTRACT

The preparation of micron sized droplets of high melting point metals by shearing the metal in the molten state into micron sized droplets while in a carrier in the form of a molten inorganic salt, glass or gas, in the presence of an oxidizing agent to form a thin protective coating on the micron sized particles while in their molten state and then allowing the formed micron sized particles to solidify.

15 Claims, 5 Drawing Figures

PREPARATION OF MICRON SIZED METAL DROPLETS

The Government has rights in this invention pursuant to Grant Nos. DMR 77-13932, ENG 76-15594, and IPA No. 0001 awarded by the National Science Foundation.

This invention relates to stabilized particles of micron size of high temperature metals and alloys and to the methods for producting same.

In our previously issued U.S. Pat. No. 4,042,374, description is made of the preparation of micron-sized spherical metal droplets by emulsification of the molten metal in a stable carrier fluid, such as a liquid, while at a temperature above the melting point temperature of the metal, and reacting to form an oxide surface on the metal while in the emulsified state, thereby to maintain emulsion integrity of the emulsified spherical particles in their finely divided separated state for subsequent solidification.

Droplets capable of being formed in accordance with the invention described in the aforementioned patent are limited to metals and alloys having fairly low melting point temperatures by reason of the limitations imposed by the stability of the fluids in which the molten metals or alloys can be emulsified for droplet formation and reaction to produce the protective layer on the surfaces thereof.

In accordance with the practice of this invention, the molten metal or alloy is dispersed to form droplets in fluids which are stable at much higher temperatures and with which a reactant can be employed to enable droplet formation with high melting point metals or alloys, including such metals and alloys as are referred to as superalloys having melting points which exceed 2100°-2700° F., thereby to extend the metals and alloys with which the concept may be practiced to include a greater number of metals and alloys with much wider applications and utilities.

Two distinct pathways may be followed in the practice of this invention to produce micron-sized particles of high melting point metals. One pathway makes use of inorganic liquids, such as molten salts or inorganic glasses as the carrier which forms the high temperature fluid in which the metal droplets can be formed, with a reactant contained therein for stabilization of the large surface area of the metal droplets produced therein, as by shear. The metal droplets produced in this way will range in diameter from 5-100$\mu$, depending upon the shear rate and the time of shear.

The stabilization of the large surface area of the metal droplets is achieved by a general oxidation treatment as used in the chemical sense to provide an exchange of electrons in a chemical reaction with the surface metal. Thus instead of merely relying on an oxidation reaction which results in the formation of an oxide of the metal as the protective coating, chemical reaction for the desired exchange of electrons at the surface to develop the protective coating can be achieved by treatment with metal chlorides, fluorides, nitrates, carbides and silicides. The essential criteria for the formation of a desirable protective coating on the surfaces of the metal droplets involves the formation of surface layers or films which are thermodynamically stable at the temperature and pressure of metal emulsification.

In accordance with the second pathway, the droplets of molten metal are dispersed in an inert space which is filled or partially filled with a gaseous medium that is inert to the metal or alloy and which is stable at the elevated temperature of the molten metal and in which the reactant to stabilize the large surface area of the droplets is preferably provided at the moment that the droplets are formed to stabilize the surface by a protective coating while the formed droplets are still in their molten state. This includes dispersion to form the droplets in a space that is maintained at subatmospheric pressure or in a microgravity environment of space, or a space which is maintained under positive pressure with an inert gas.

Formation of a stable emulsion when a liquid metal or alloy is sheared into a fine droplet dispersion in accordance with the first pathway for the practice of this invention entails the requirements of a suitable carrier fluid, and an appropriate oxidant. The primary requirement of the carrier fluid is low volatility and tolerance to an oxidizing environment at temperatures above the melting point temperature of the metal or alloy. The major limitation as to which metals and alloys can be emulsified by this technique is the boiling point of the carrier fluid, herein identified as a molten salt or molten inorganic oxide or glass and the reactivity to same. Silicate glasses and boron trioxide are representative of the glasses and molten oxides that can be used as high temperature carrier fluids in which the metal or alloy can be emulsified. These materials have adequate fluidity to allow for high speed emulsification and they are also reasonably stable and inert to oxidation in the temperature range above 500° C. and up to or beyond 1800° C.

As representative of such glasses, use can be made of lead oxide (PbO) containing 13 mol% $B_2O_3$ having a eutectic melting point temperature of about 494° C. with an upper temperature limit of 1400° C. The preferred use is made of this glass in the range of 525°-1300° C.; boron trioxide glass ($B_2O_3$) having a melting point temperature of about 460° C., with the upper limit of use being its boiling point temperature of 1860° C.; borosilicate glasses usable in the range of 800°-1500° C., such as formed of 25 mol% $Na_2O$, 30-40 mol% $B_2O_3$, with the balance being $SiO_2$. With the $B_2O_3$ glass, the shearing necessary for emulsification of the metal therein is difficult to achieve at temperatures below 850° C. because of high viscosity. With such liquid carrier, the preferred temperature for use is within the range of 950°-1750° C.

Metal salts that can be used as fluids can be represented by a binary 58 mol% LiCl-42 mol% KCl mixture with a melting temperature of 354° C. and a boiling point above 1350° C. and a 10 mol% NaCl-35 mol% KCl-55 mol% LiCl ternary eutectic mixture having a melting point temperature of about 346° C. and a boiling temperature of about 1400° C. Metal emulsification is preferably carried out while the eutectic salt mixture is at a temperature within the range of 400°-1300° C.

Reactants that can be used with the fluids to effect oxidation of the formed metal droplets can be represented by chromic oxide ($CrO_3$), phosphotungstic acid ($P_2O_5.24WO_3.H_2O$), phosphomolybodic acid and molybodic oxide. Other inorganic oxides or compounds that release oxygen or a metal compound forming element at high temperature in favor of a lower oxidation state relative to the metal to be emulsified can also be used.

The concentration of the oxidizing agent which may be embodied in the fluid carrier is illustrated in the following example which is given by way of illustration and not by way of limitation of the concepts of this invention wherein use is made of a liquid carrier for metal emulsification.

EXAMPLE 1

For Ni: 1 gm of metal in 10 gm of inert carrier fluid. If 1 gm of metal is emulsified into a monodisperse collection of 10μ droplets, there will be about $2\times10^8$ droplets. Each droplet will have a surface area of about $3\times10^{-6}$ cm$^2$. The total droplet collection will have a combined surface area of about 670 cm$^2$. For a monolayer coverage of oxygen on each droplet $1.8\times10^{-6}$ moles of oxygen are required. A surfactant oxidant such as $WO_3$ at a 1% concentration by weight can supply a maximum of $1.3\times10^{-3}$ moles of oxygen to form a droplet film coating. At this level, there is sufficient oxygen supplied to form almost $10^3$ layers of nickel oxide (NiO) on the surface of each Ni droplet. However, this simple illustration assumes perfect efficiency in transferring the oxidant from within the carrier fluid to the metal droplet surface and in the reaction kinetics between the oxidant and the metal. In practice, the action of the oxidant in forming a stabilizing coating will not likely be perfectly efficient. Also, in reality droplets are polydisperse rather than monodisperse. When realistic reaction efficiencies are considered, it has been our experience that for a wide variety of metals and carrier fluids, up to 1% of oxidant by weight will yield a stabilized droplet emulsion.

EXAMPLE 2

Emulsions of pure lead (Pb) and a silver antimony eutectic alloy containing 44 wt.% Sb were prepared by shear in a PbO-13 mol% $B_2O_3$ eutectic glass carrier fluid at 700° C. with 1% by weight $CrO_3$ present in the carrier fluid as the oxidizing agent. The PbO-13 mol% $B_2O_3$ glass carrier fluid and oxidant were placed in a nickel emulsification tube heated to a temperature of 700° C. The emulsification tube was formed in the shape of a clover leaf along its axis to enhance shear.

A sample of 1 gram of solid metal was added per 20 grams of molten carrier fluid. When the metal melted and settled into the liquid glass, the shearing rotor of an emulsification unit was inserted into the emulsification tube. During these operations, an inert gas cover, such as an argon, was employed to purge the atmosphere over the carrier. Droplets of metal suspended in the glass were produced by shearing the carrier-glass metal mixture at 30,000 rpm for 1 minute. Subsequently, the emulsion was poured from the emulsification tube onto a metal plate at room temperature to form a thin disc of hard glass containing the droplets of metal.

A photomicrograph of the polished interior section of lead droplets contained in the PbO-13 mol% $B_2O_3$ eutectic glass is given in FIG. 1. The appearance of the embedded metal indicates that the droplets have a fairly uniform spherical shape. In addition, there is no evidence for the presence of an excessively thick surfactant film coating. When contained within the carrier fluid medium, such droplets are capable of sustaining numerous melting and freezing thermal cycles and while maintaining their independence, size and spherical shape. The melting and freezing behaviour is illustrated in FIG. 2 which represents a differential thermal analysis record for the emulsion. A clean sharp melting is evident at 327° C., the melting point of pure Pb, confirming that no significant contamination or reaction occurred between the metal and eutectic glass carrier fluid medium. The freezing of the Pb droplets is recorded at 287° C. which is 40° C. below the melting point and indicates the potential of the metal to produce undercooled liquids. This behavior confirms that the invention method can be utilized to produce stabilized metal droplet emulsions. Optical microscopy revealed that the metal droplets ranged in cross section from 10–50 μm.

FIG. 3 is a schematic illustration of a device suitable for use in the production of metal droplets by rotary shear in a carrier fluid as described in example 1 and 2.

EXAMPLES 3, 4, 5 AND 6

Emulsions of lead (example 3), bismuth (example 4), zinc (example 5) and antimony (example 6) were prepared in the apparatus of FIG. 3, using a molten ternary salt eutectic of 10 mol% NaCl, 35 mol% KCl, and 55 mol% LiCl at 575° C. Phosphomolybodic acid was added in an amount to provide a concentration of about 1% by weight in the salt carrier fluid to serve as the oxidation reactant.

The emulsification procedure was the same as that in example 2. When the emulsification was completed, the dispersion of molten metal droplets in the molten salt was allowed to cool until both solidified. The metal droplets were freed from the carrier by dissolving out the salt in water. The isolated metal droplets were of a dimension ranging from 10 to 70 μm in diameter. FIG. 4 is a photomicrograph of the formed droplets of antimony.

EXAMPLE 7

Emulsions of lead and zinc were prepared in a binary salt carrier of 42 mol% KCl-58 mol% LiCl by shear in an emulsification apparatus of the type shown in FIG. 5 at 500° C. The apparatus consists of two cylindrical portions of about ¾" in length and ½" in diameter. The two portions fit snugly into each other and contain a metal screen at the connecting point. The screen is in the form of a disc of about ⅛" in thickness containing a plurality of passages of 0.04".

To prepare an emulsion with this apparatus, a mixture of 4 gm. of salt, 0.5 gm of metal and phosphotungstic acid in an amount to provide 1% concentration is placed in one portion of the cylinder after which the assembly is sealed. Upon heating to a temperature of 500° C. under an argon gas cover, the metal and salt become molten and the apparatus is shaken by and up and down motion along the axis of the cylinder. At a shaking rate of 2000 cycles per minute, the metal-salt mixture is forced through the separating screen to create a dispersion of metal droplets in the molten salt. In accordance with this procedure, metal droplets have been produced in the size range of 10–100 μm.

EXAMPLE 8

An emulsion of a silver-28 weight % copper alloy with a melting temperature of 779° C. was prepared in an inorganic oxide glass carrier fluid of $B_2O_3$-20 mol% $Na_2O$ with an emulsification apparatus constructed as shown in FIG. 5 from inconel. To prepare an emulsion with this shaker emulsification apparatus a temperature of 1050° C. was used to insure adequate fluidity of the oxide glass carrier fluid. A mixture of 4.5 grams of oxide glass and 0.5 grams of metal alloy is placed in one portion of the cylinder after which the shaker capsule is sealed. Upon heating to a temperature above about 1050° C., the metal alloy and oxide glass become molten and fluid (i.e. viscosity less than about 100 Poise). The apparatus is shaken by an up-and-down motion at a rate of 2000 cycles per minute forcing the metal-glass mixture through the separating screen to create metal droplets dispersed in the molten glass. During the shaking and dispersal operation, a small quantity of dried air in an amount of 0.5% by volume of the argon cover gas flow is added to the shaker capsule chamber. In accordance with the practice of this procedure, metal alloy droplets have been produced in the size range of 20 to 60 μm. The droplets retain their shape, size and independence upon thermal cycling from room temperature to 1000° C.

When following the second pathway, the molten metal or alloy can be formed into droplets, as by atomization, separate and apart from the fluid, in which event, reliance is had on the gaseous fluid as a carrier for the reactant and for quenching the droplets of molten metal. In order to maintain the desired separation of the fluid droplets and to minimize agglomeration, it is desirable to make the reactant available to the area where the droplets are formed or being formed to enable surface reaction before the metal is cooled.

Ideally, the reactant may be supplied with the molten metal so that the reactant will be available preferably in the form of a gas at molten metal temperature, as the droplets of molten metal are formed for in situ reaction with the newly formed surfaces of the molten metal droplets.

Representative of one such means by which droplets can be formed of molten metals comprises the well known spinning disc atomizer in which the molten metal is caused to flow in a continuous stream onto the surface of a rapidly rotating disc from which the molten metal is thrown as fine micron-sized droplets from the periphery thereof.

The reactant to stabilize the surface of the newly formed micron-sized droplets can be provided as a gaseous medium in admixture with the carrier gas. For most efficient and effective utilization of such reactant, it is preferred to introduce the reactant gas into the carrier gas at the site of droplet formation, as at the point of atomization, or the reactant can be deposited directly onto the disc for flow with metal during atomization thereby to be immediately available for reaction in the area of droplet formation as the formed droplets are thrown from the disc into the surrounding carrier gas for quenching.

Instead of the spinning disc technique for reducing the molten metal or alloy into fine micron-sized droplets for dispersion in a surrounding inert gas, use can be made of other techniques well known in the art, such as the Lea Flash Reactor-Contactor marketed by Rhone-Poulenc Industries of Paris, France, wherein a linear stream of liquid material is engaged by a stream of hot inert gas in hyperbolic flow at high velocity with a momentum 100 times and preferably more than 1,000 times the momentum of the liquid stream whereby, upon engagement, the liquid stream is broken up into extremely fine micron-sized particles which become entrained for laminar flow with the gaseous flow which continues in hyperbolic flow. When the liquid stream is represented as a stream of molten metal or alloy and the gaseous stream is represented as the carrier fluid in the form of an inert gas containing a reactant in the form of an oxidizing gas, the molten metal will be reduced to fine droplets in the gaseous carrier in the presence of the reactant to stabilize the surface of the metal droplets before the metal droplets are quenched.

For metal emulsification in a gaseous medium, use can be made of an inert gas such as helium, argon or nitrogen.

Representative of the oxidants which may be used for reaction in situ to form an oxide surface layer on the droplets that are formed include low pressure oxygen at $10^{-5}$ mm Hg, water vapor, sulfur dioxide, carbon monoxide and organophosphates at low partial pressures such as about $10^{-5}$ mm Hg. Overall oxidation should not exceed 5% of the total metal throughput during emulsification.

As a modification of the second pathway, advantage can be taken of some of the unique features of the natural environment of space. Among these features, the microgravity associated with the usual acceleration levels of the order of $10^{-5}$ to $10^{-7}$ g and the high vacuum levels of the order about $10^{-8}$ mm Hg existing in space, are relevant to the formation of stabilized micron size metal droplets. The significance of microgravity is that crucibles need not be used to contain molten material. In turn, this indicates that the development and application of an inert carrier fluid for high temperature emulsification of metals can be bypassed under microgravity conditions. An important consequence that is related to the removal of the need for a carrier fluid is the simplification that is possible in carrying out controlled surfactant droplet coating reactions at high temperature. With this approach, one follows the practice of forming droplets by dispersal from a molten metal source such as a stream or bulk mass. Without the restraint of normal terrestrial gravity conditions, droplet independence will be maintained as the formed droplets spread out in space from the point of dispersal under the action of the forces employed for emulsification. As with other droplet formation methods involving an inert gaseous medium as a carrier fluid, droplets will be stabilized by the formation of a film coating through a controlled gaseous oxidizing treatment at the point of metal emulsification into droplet form. Droplet film formation will provide for the maintenance of droplet shape upon freezing of the liquid metal and provide for the stability of the dispersion to any subsequent handling, including thermal treatment.

The following example is given by way of illustration of the concept of droplet formation using a gaseous carrier and a spinning disc for emulsification of the metal droplets in the gaseous carrier.

EXAMPLE 9

In the region of the emulsifier, near the spinning disc, the area is blanketed with an argon atmosphere containing a partial pressure of $SO_2$ in the range of $10^{-4}$ to $10^{-5}$ mm Hg so that the molten metal droplets thrown from the periphery of the spinning disc will travel through a layer of hot carrier gas several centimeters thick before the same droplets enter a surrounding cold helium gas for cooling the metal droplets. This system can be used to advantage with such metals as nickel and iron based alloys to alter the solidification microstructure by controlling the nucleation temperature. Some of the microstructural changes that may be achieved include refinement of grain size and the formation of metastable solid solutions and metastable crystal phases and the production of amorphous phases.

The use of the spinning disc technique to form metal droplets of small dimension is well known to the skilled in the art. The concepts of this invention reside in the formation of such metal droplets in an inert atmosphere containing oxidizing gas in the immediate vicinity of the spinning disc so as to form the protective layer of metal oxide on the surface before the metal droplets project into the gaseous atmosphere in which they are quenched.

The methods of producing droplets need not be limited to those involving mechanically induced forces such as shear or the spinning disc. Quite satisfactory metal droplets can be produced by the application of other well-known techniques of liquid dispersion such as ultrasonic and electrical atomization. The principles described in the current invention pertaining to the formation of stabilized droplets through controlled chemical surfactant reaction apply to other atomization techniques. The unique feature of droplet coatings is that different coatings can yield different behavior during processes such as freezing and solid state heat treatment.

It will be understood that changes may be made in the details of formulation and operation, as well as in the materials and amounts that are embraced, without departing from the spirit of the invention, especially as defined in the following claims.

Figure 1:
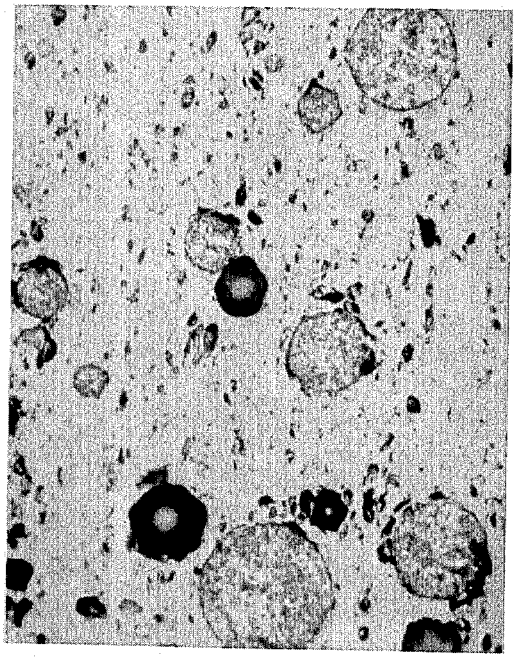
FIG. 1 is a photomicrograph of lead droplets in an eutectic glass.
Figure 4:
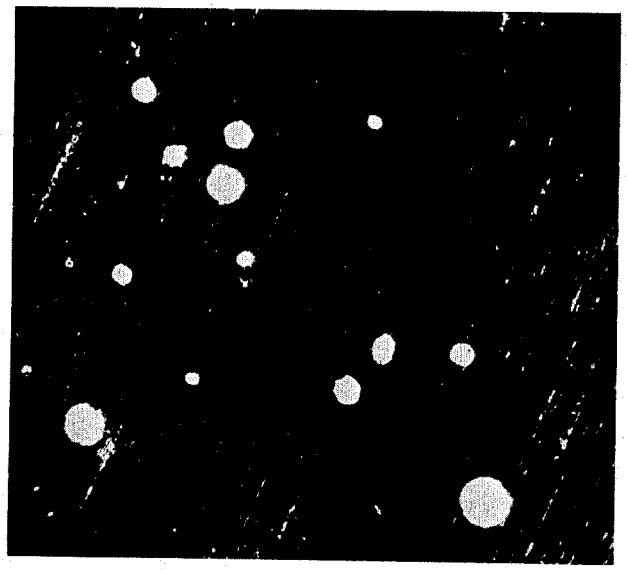
FIG. 4 is a photomicrograph of antimony droplets in a salt carrier.
Figure 2:
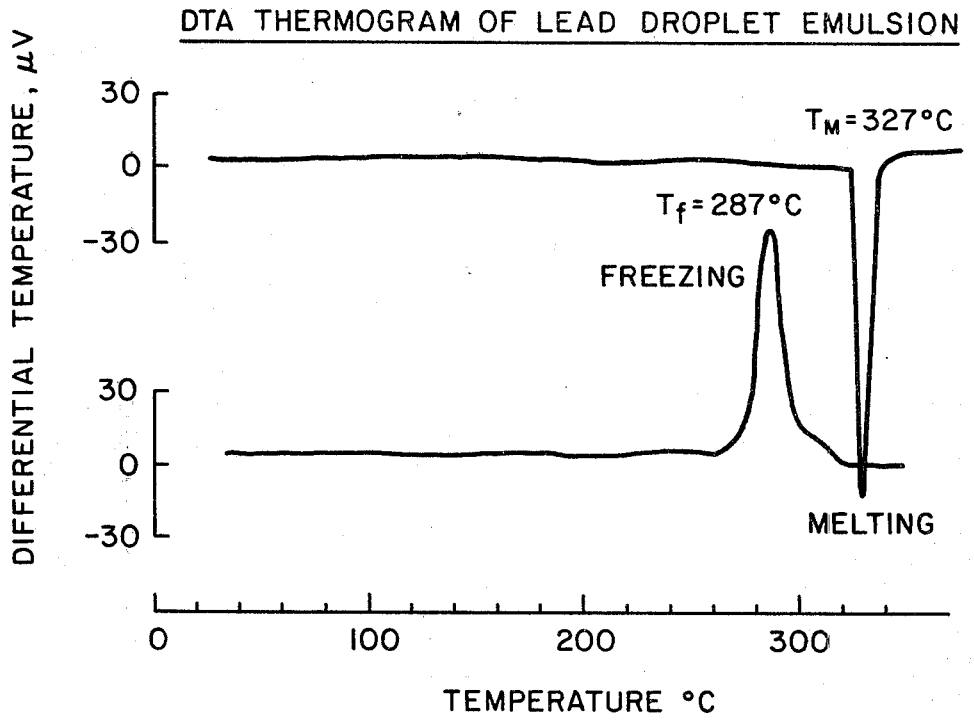
FIG. 2 is a differential thermal analysis record of the melting and freezing of lead droplets in an eutectic glass.
Figure 5:
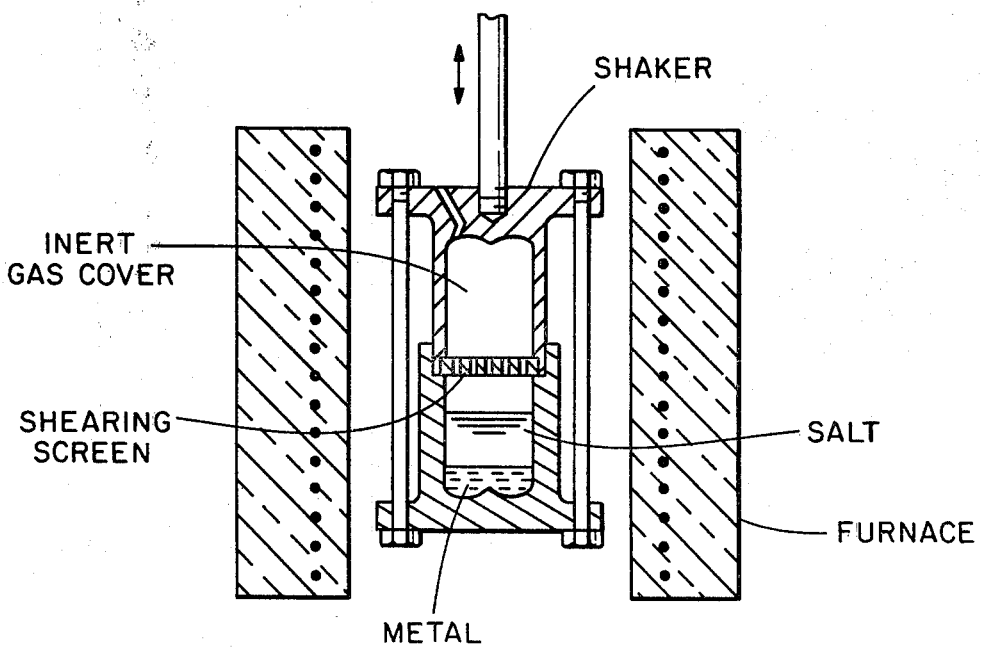
FIG. 5 is a schematic illustration of an emulsification apparatus for producing metal droplets of this invention.
Figure 3:
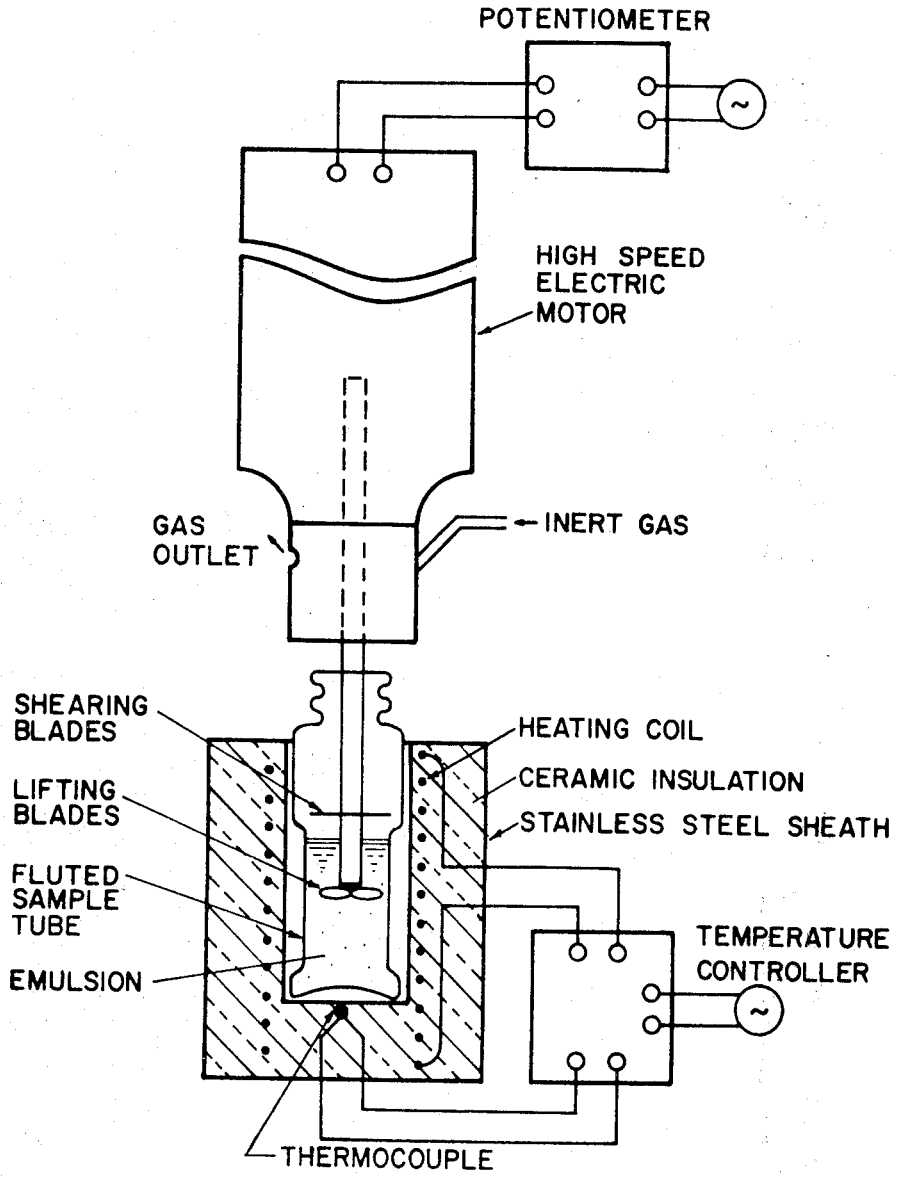
FIG. 3 is a schematic illustration of an apparatus which makes use of shear for production of metal droplets in accordance with the practice of this invention.

We claim:

1. The method of preparing micron sized droplets of metals having a high melting point, such as superalloys having a melting point above 2100°–2700° F., comprising reducing the metal to micron sized particles while at a temperature above its melting point in the carrier to emulsify the metal as fine micron sized droplets in the fluid or gas, and exposing the metal, while in the emulsified state in said fluid or gas, to a reaction medium to form a protective layer on the surfaces of the droplets for protection of the droplets against agglomeration, and cooling the metal droplets to their solidified state to produce separated micron sized particles of the metal.

2. The method as claimed in claim 1 in which the metal is reduced to micron sized particles in a carrier in the form of space, gas, or fluid which is stable at temperatures above the melting point of the metal.

3. The method as claimed in claim 2 in which the carrier is an inorganic salt or glass.

4. The method as claimed in claim 2 in which the carrier is a gas which is inert to the metal dispersed therein.

5. The method as claimed in claim 1 in which the molten metal is reduced by shear to micron sized particles.

6. The method as claimed in claim 1 in which the molten metal is dispersed as micron sized droplets for emulsification in a carrier in the form of a gas by flowing the metal as a molten stream onto the surfaces of a disc spinning at high velocity whereby the metal is thrown from the periphery of the spinning disc as micron sized particles and maintaining an atmosphere of inert gas in the area immediately surrounding the disc.

7. The method as claimed in claim 6 which includes the step of introducing the reaction medium onto the disc for intimate contact with the micron sized metal particles upon formation for in situ reation to form the protective surface layer while the particles are freshly formed in the molten state.

8. The method as claimed in claim 6 which includes the step of introducing the reaction medium as a gas into the atmosphere immediately surrounding the spinning disc for in situ reaction to form a protective layer on the freshly formed metal droplets while still in their molten state.

9. The method as claimed in claim 1 in which the molten metal is dispersed as micron sized droplets for emulsification in a carrier in the form of a gas by impacting a stream of the molten metal with the gas having a momentum much greater than the momentum of the stream of molten metal whereby the stream of molten metal is sheared into micron sized droplets which become entrained with the gaseous stream and introducing a gaseous reaction medium into the stream of gaseous material prior to impact with the molten metal for in situ reaction with the micron sized droplets as they are formed to provide a protective layer on the surfaces of the micron sized droplets.

10. The method as claimed in claim 1 in which the reaction medium is one that induces a general oxidation reaction.

11. The method as claimed in claim 1 in which the molten metal is reduced to micron sized particles by ultrasonic forces.

12. The method as claimed in claim 1 in which the molten metal is reduced to micron sized particles by dielectric atomization.

13. The method as claimed in claim 1 in which the reaction medium provides a controlled chemical surfactant reaction.

14. The method as claimed in claim 1 in which the metal is reduced to micron sized particles in space environment at subatmospheric pressure.

15. The method as claimed in claim 2 in which the carrier gas in which the molten metal is reduced to micron sized particles is an inert gas.

* * * * *